US008420285B2

(12) United States Patent
Kato

(10) Patent No.: US 8,420,285 B2
(45) Date of Patent: Apr. 16, 2013

(54) COATED CARRIER REGENERATING METHOD, DEVELOPING CARTRIDGE CONTAINING TWO COMPONENT DEVELOPER CONTAINING TONER AND COATED CARRIER REGENERATED BY SAME COATED CARRIER REGENERATING METHOD, AND IMAGE FORMING APPARATUS DETACHABLY PROVIDED WITH SAME DEVELOPING CARTRIDGE

(75) Inventor: Takeshi Kato, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 361 days.

(21) Appl. No.: 12/821,464

(22) Filed: Jun. 23, 2010

(65) Prior Publication Data

US 2010/0330483 A1 Dec. 30, 2010

(30) Foreign Application Priority Data

Jun. 24, 2009 (JP) ..... 2009-149471

(51) Int. Cl.
*G03G 9/113* (2006.01)

(52) U.S. Cl.
USPC ..... 430/111.3; 430/111.1; 399/222

(58) Field of Classification Search ..... 430/111.1, 430/111.3; 399/222
See application file for complete search history.

(56) References Cited

U.S. PATENT DOCUMENTS

| | | | | |
|---|---|---|---|---|
| 5,965,317 | A | 10/1999 | Sano | |
| 6,464,797 | B1 * | 10/2002 | Sugiyama et al. | 134/10 |
| 2004/0062559 | A1 | 4/2004 | Kinoshita et al. | |
| 2005/0196185 | A1 | 9/2005 | Kinoshita et al. | |

FOREIGN PATENT DOCUMENTS

| | | | |
|---|---|---|---|
| JP | 3-089254 A | | 4/1991 |
| JP | 2000-235281 | | 8/2000 |
| JP | 2001-042576 | | 2/2001 |
| JP | 2001-134066 | | 5/2001 |
| JP | 3267750 | | 1/2002 |
| JP | 2002055588 | | 2/2002 |
| JP | 2002-229275 | | 8/2002 |
| JP | 2002-251057 | * | 9/2002 |
| JP | 2004-139046 | | 5/2004 |
| JP | 2005-300676 | | 10/2005 |
| JP | 2009-015046 | | 1/2009 |

OTHER PUBLICATIONS

Translation of JP 2002-251057 published Sep. 2002.*
Diamond, "The Handbook of Imaging Materials," Marcel Dekker, NY, NY 1993, pp. 380-382.*

* cited by examiner

*Primary Examiner* — Peter Vajda
(74) *Attorney, Agent, or Firm* — Nixon & Vanderhye P.C.

(57) ABSTRACT

A coated carrier regenerating method in accordance with the present invention includes the step of: determining an amount of a worn-away coating resin of a used coated carrier. Accordingly, an amount of the coating resin layer to be supplemented, namely an amount of the coating resin with which the coating resin layer is to be supplementarily coated is found based on this amount of the worn-away coating resin, whereby the supplementary coating of the used coated carrier can be carried out with the coating resin in the amount thus determined. This allows regeneration of a coated carrier in which a coating resin has a uniform thickness, that is, a coating resin layer has a thickness which is unchanged from the thickness obtained before use of the coated carrier, without the need of completely removing the coating resin from the used coated carrier. According to the method of the present invention as mentioned above, it is possible to easily regenerate, in a shorter time and at a lower cost, a coated carrier in which a coating resin layer has a uniform thickness.

8 Claims, 6 Drawing Sheets

COATED CARRIER REGENERATING METHOD, DEVELOPING CARTRIDGE CONTAINING TWO COMPONENT DEVELOPER CONTAINING TONER AND COATED CARRIER REGENERATED BY SAME COATED CARRIER REGENERATING METHOD, AND IMAGE FORMING APPARATUS DETACHABLY PROVIDED WITH SAME DEVELOPING CARTRIDGE

This Nonprovisional application claims priority under 35 U.S.C. §119(a) on Patent Application No. 2009-149471 filed in Japan on Jun. 24, 2009, the entire contents of which are hereby incorporated by reference.

TECHNICAL FIELD

The present invention relates to a method for regenerating a coated carrier used for an image forming apparatus employing an electrophotographic printing method.

BACKGROUND ART

An image forming apparatus employing an electrostatic electrophotographic printing method performs the steps of: charging, exposure, development, transfer, separation, cleaning, and fixation, so as to form an image on a transfer material (recording material) such as paper. Specifically, a surface of a photoreceptor drum which is driven to rotate by a charging device is uniformly charged (charging). Then, a laser beam is directed, by an exposure device, toward the photoreceptor drum thus charged, whereby an electrostatic latent image is formed (exposure) on the photoreceptor drum. Subsequently, the electrostatic latent image on the photoreceptor drum is developed by a developing device so that a toner image is formed on the surface of the photoreceptor drum (development). Then, the toner image on the photoreceptor drum is transferred to the transfer material by a transfer device (transfer). Thereafter, the toner image is heated by a fixing device, whereby the toner image is fixed onto the transfer material (fixation).

A developer for developing the electrostatic latent image on the photoreceptor drum is a single component developer containing only a toner or a two component developer containing the toner and a carrier. The single component developer requires no stirring system in which the toner and the carrier are mixed together and thus the developing device has a simple structure. However, on the other hand, the single component developer has at least a problem that a charge amount of the toner is less likely to be stable. In contrast, the two component developer requires a stirring system in which the toner and the carrier are mixed together. However, according to the two component developer, the charge amount of the toner is highly likely to be stable and it is therefore possible to obtain a high-definition image.

However, there occurs a problem that long-term use of the two component developer causes a surface of the carrier to be worn, thereby leading to a change in electric resistance and charge property. The change in electric resistance and charge property causes a deterioration in image quality. In order to solve this problem, the carrier is coated with a coating resin, so as to cause the surface of the carrier to be more wear-resistant. However, even if the surface of the carrier is coated with the coating resin as described above, the two component developer still has a shorter lifetime as compared to the image forming apparatus. For this reason an old two component developer (carrier) which has reached its lifetime is replaced with a new two component developer (carrier), whereby the deterioration in image quality is prevented.

Note that from an environmental viewpoint, reuse of an old carrier is suggested so that a smaller amount of a used carrier is disposed of. For example, Patent Literature 1 discloses a carrier regenerating method in which a coating resin of a used carrier is removed by hydrolysis and thereafter resulting core particles are coated with the coating resin.

CITATION LIST

Patent Literature 1

Japanese Patent Application Publication, Tokukai, No. 2005-300676 A (Publication Date: Oct. 27, 2005)

SUMMARY OF INVENTION

Technical Problem

However, there is a problem that such a carrier regenerating method is less practical. This is because complete removal of the coating resin from the carrier requires a considerable amount of time and consequently regeneration of the carrier costs high. Note that in a case where the carrier is supplementarily coated with the coating resin by saving time of removing the coating resin or without carrying out the removal of the coating resin, a part of the coating resin which has not been removed remains on the surface of the core particle. This causes a problem that a coating resin layer of a regenerated carrier has a larger thickness (film thickness) and then becomes nonuniform as the number of regeneration of the carrier increases.

The present invention has been made in view of the problems, and an object of the present invention is to provide at least a method which allows, in a shorter time and at a lower cost, easy regeneration of a coated carrier in which a coating resin layer has a uniform thickness irrespective of an increase in number of times of regeneration of a coating resin.

Solution to Problem

In order to attain the object, a coated carrier regenerating method of the present invention in which a coated carrier whose surface is coated with a coating resin layer is regenerated from a used coated carrier by supplementarily coating the surface of the used coated carrier with a coating resin, the coated carrier regenerating method includes the step of: (a) determining an amount of a worn-away coating resin of the used coated carrier.

Advantageous Effects of Invention

According to the method, the amount of the worn-away coating resin is determined in a case where the coated carrier is regenerated by supplementarily coating the used coated carrier with the coating resin. Accordingly, an amount of the coating resin layer to be supplemented, namely an amount of the coating resin with which the coating resin layer is to be supplementarily-coated is found based on this amount of the worn-away coating resin, whereby the supplementary coating of the used coated carrier can be carried out with the coating resin in the amount thus determined. This allows regeneration of a coated carrier in which a coating resin has a uniform thickness, that is, a coating resin layer has a thickness which is unchanged from the thickness obtained before use of the coated carrier, without the need of completely removing the coating resin from the used coated carrier.

Note here that it has been conventionally unnecessary to find an amount of a worn-away coating resin in a case where coating is carried out after a coating resin is removed. Alternatively, even in a case where supplementary coating is carried out without removing the coating resin, the coating has been carried out without finding the amount of the worn-away coating resin. Thus, the amount of the worn-away coating resin has not been found. Therefore, in a case where the supplementary coating is carried out and a part of the coating resin remains on a surface of a core particle, a coating resin layer of a regenerated carrier has a larger thickness and then becomes nonuniform as the number of regeneration of the carrier increases.

However, according to the method of the present invention, the amount of the worn-away coating resin is determined. Therefore, it is possible to easily regenerate a coated carrier in which a coating resin layer has a uniform thickness irrespective of an increase in number of times of regeneration of a coating resin, while saving time and costs required to remove the coating resin before regenerating the coating resin.

DESCRIPTION OF EMBODIMENTS

An embodiment of the present invention is described below with reference to the drawings. According to a coated carrier regenerating method of the present invention, an amount of a coating resin to be used with which a coated carrier is supplementarily coated is determined in accordance with an amount of a worn-away coating resin which is a worn-away thickness of a coating resin of a used coated carrier. The following description first discusses an embodiment of an image forming apparatus in which a coated carrier and a regenerated coated carrier which are in accordance with the present invention are used. The coated carrier regenerating method in accordance with the present invention is to be described later.

[Image Forming Apparatus]

Figure 1:
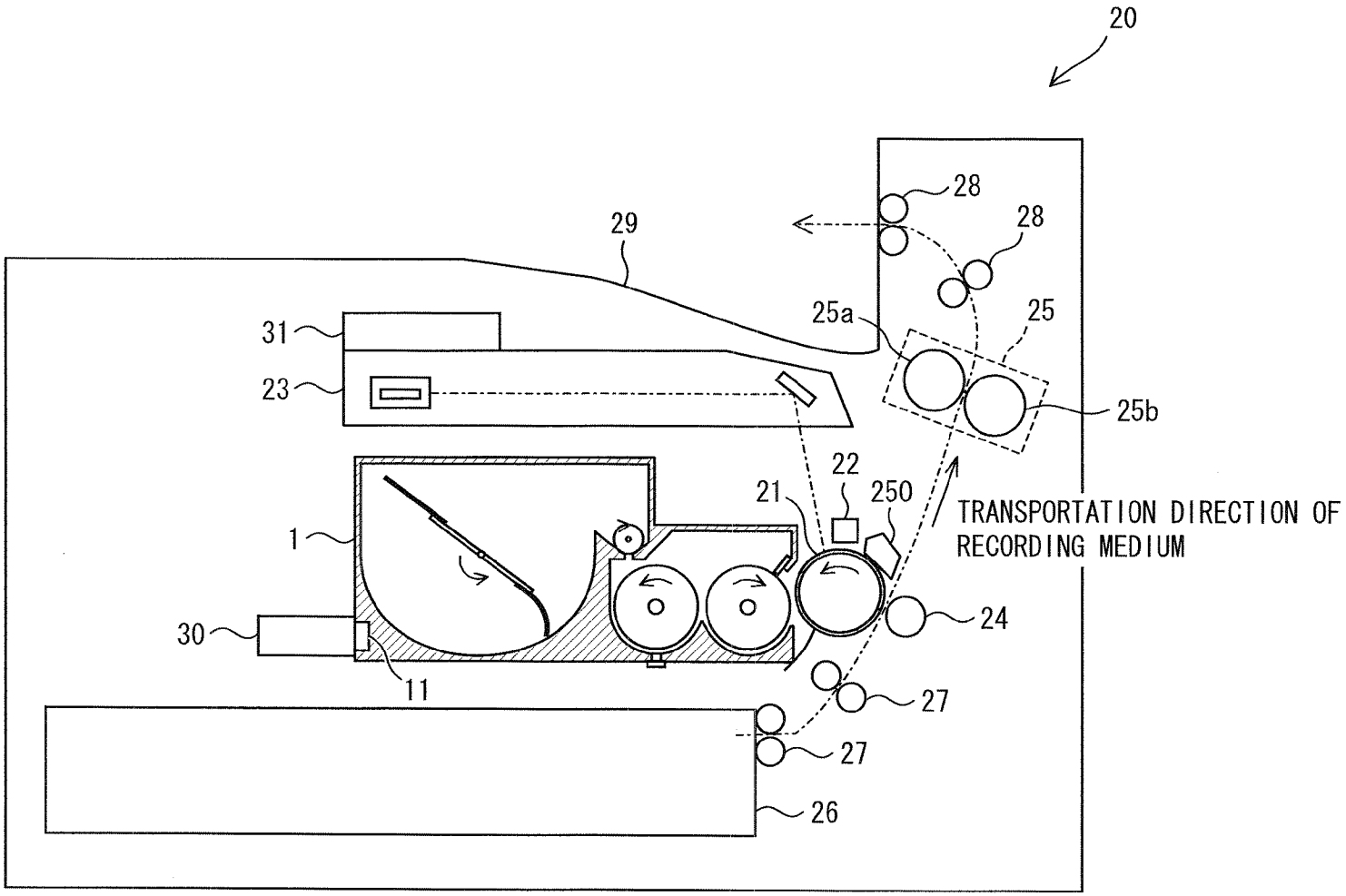
FIG. 1 is a block diagram schematically illustrating an image forming apparatus in accordance with the present invention.
Figure 2:
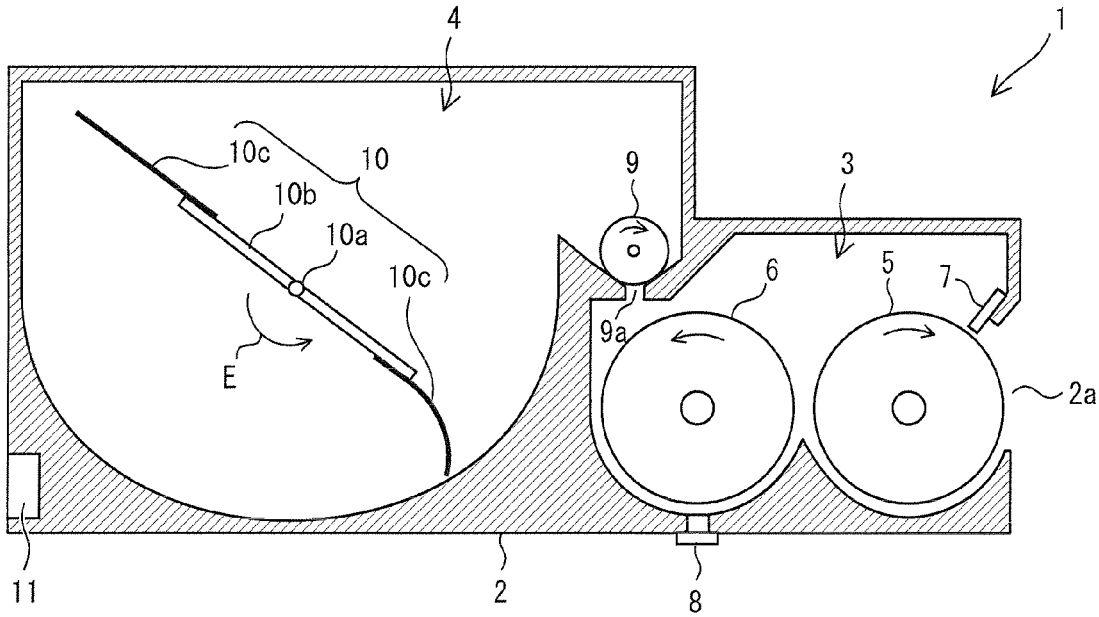
FIG. 2 is a cross-sectional view illustrating an arrangement of a developing cartridge included in the image forming apparatus.

FIG. 1 is a block diagram illustrating an arrangement of an image forming apparatus in accordance with the present invention in which image forming apparatus the coated carrier in accordance with the present invention is used. FIG. 2 is an enlarged view illustrating an arrangement of a developing cartridge 1 of an image forming apparatus 20 illustrated in FIG. 1. First, the following description discusses a whole arrangement of the image forming apparatus 20.

The image forming apparatus 20 includes a photoreceptor drum 21 on which surface an electrostatic latent image is formed, a charging device 22 for electrically charging the surface of the photoreceptor drum 21, an exposure device 23 for causing the electrostatic latent image to be formed on the surface of the photoreceptor drum 21, the developing cartridge 1 for supplying a toner to the surface of the photoreceptor drum 21 so as to cause the electrostatic latent image to be visible (developed) as a toner image, a cleaning device 250 for cleaning the surface of the photoreceptor drum 21, a transfer device 24 for transferring the toner image on the surface of the photoreceptor drum 21 to a recording medium (paper/a transfer material), a fixing device 25 for fixing the toner image onto the recording medium, a paper feeding cassette 26 in which the recording medium is contained, a paper output tray 29 in which the recording medium onto which the toner image has been fixed is stored, an information processing section 30 which reads and writes information stored from/in an information storage section 11 of the developing cartridge 1, an image processing apparatus 31 which receives image information from an external device such as a document scanning device (a scanner) or a personal computer, converts the image information to an electric signal and then supplies the converted electric signal to the exposure device 23 (see FIG. 1). Note that the developing cartridge 1 includes the information storage section 11 and is detachably provided in the image forming apparatus 20.

The photoreceptor drum 21 is supported by drive means (not illustrated) so as to be driven to rotate around its axis. The photoreceptor drum 21 is made of a roller-shaped member on which surface the electrostatic latent image and consequently the toner image is formed. For example, a roller-shaped member containing an electroconductive base (not illustrated) and a photoreceptor material (not illustrated) formed on a surface of the electroconductive base is usable for the photoreceptor drum 21. A cylindrical, columnar, or sheet-like electroconductive base is usable for the electroconductive base, and the cylindrical electroconductive base is particularly preferable among such electroconductive bases. The photoreceptor drum 21 is exemplified by an organic photoreceptor drum and an inorganic photoreceptor drum.

The charging device 22 electrically charges the photoreceptor drum 21 by discharge. For example, a sawtooth charger can be employed for the charging device 22. Not only the sawtooth charger but also a non-contact charger or a contact-type charger such as a charging brush-type charger, a roller-shaped charger, or a magnetic brush is usable as the charging device 22.

Note that a power supply (not illustrated) is connected to the charging device 22 and a voltage is applied from this power supply to the charging device 22. Accordingly, the charging device 22 causes, in response to the voltage application from the power supply, the surface of the photoreceptor drum 21 to be charged to have a given polarity and a given electric potential.

The exposure device 23 is arranged such that image data is entered via the external device and signal light corresponding to image information is directed toward the surface of the photoreceptor drum 21 which surface has been charged. This causes the electrostatic latent image corresponding to the image information to be formed on the surface of the photoreceptor drum 21. A laser scanning device including a light source is used as the exposure device 23 herein.

The transfer device 24 is arranged to be (i) made of a roller-shaped member, (ii) rotatably supported by a supporting member (not illustrated), (iii) rotatable by drive means (not illustrated), and (iv) pressured against the photoreceptor drum 21.

Recording mediums are one-by-one fed from the paper feeding cassette 26 via a paper feeding roller 27 to a pressure area (a transfer nip area) between the photoreceptor drum 21 and the transfer device 24, in sync with transportation of the toner image by rotation of the photoreceptor drum 21.

The recording medium passes through the transfer nip area between the photoreceptor drum 21 and the transfer device 24, whereby the toner image on the photoreceptor drum 21 is transferred to the recording medium.

The transfer device 24 is connected to a power supply (not illustrated). In order to transfer the toner image to the recording medium, a voltage whose polarity is reverse to a charging polarity of the toner of which the toner image is made is applied to the transfer device 24. This causes the toner image to be smoothly transferred to the recording medium.

The cleaning device 250 includes a cleaning blade (not illustrated) and a toner storage tank (not illustrated). At least the toner and paper powder, each remaining on the surface of the photoreceptor drum 21, are removed by the cleaning blade. The toner removed by the cleaning blade is temporarily stored in the toner storage tank, which is made of a container-like member having an interior space.

The fixing device 25 includes a heat roller 25*a* and a pressure roller 25*b*. The heat roller 25*a*, which is made of a roller-shaped member and rotatably supported by a supporting member (not illustrated), is provided so as to be rotatable around its axis by drive means (not illustrated). This heat roller 25*a* has inside a heat member (not illustrated) which heats unfixed toner of the toner image supported by the recording medium transported from the transfer nip area. The heat roller 25*a* melts and fixes the toner onto the recording medium.

The pressure roller 25*b* is arranged to be (i) made of a roller-shaped member, (ii) rotatably supported, and (iii) pressured against the heat roller 25*a* by a pressure member (not illustrated). This pressure roller 25*b* is driven to rotate together with rotation of the heat roller 25*a*. A pressure area between the heat roller 25*a* and the pressure roller 25*b* is referred to as a fixing nip area. The pressure roller 25*b* promotes the fixation of the toner image onto the recording medium by pressing the melted toner against the recording medium during the thermal fixation of the toner image onto the recording medium by the heat roller 25*a*. A roller-shaped member which is identical in arrangement to the heat roller 25*a* is usable as the pressure roller 25*b*. Note that a heat member can be provided also inside the pressure roller 25*b*. A heat member which is similar to the heat member provided inside the heat roller 25*a* is usable as this heat member.

The fixing device 25 is arranged such that, while the recording medium to which the toner image has been transferred is passing through the fixing nip area, the toner of which the toner image is made is melted and the toner image is pressed against and then fixed onto the recording medium. The recording medium on which an image is printed is then discharged via a paper feeding roller 28 to the paper output tray 29.

The paper feeding cassette 26 refers to a tray in which a recording medium such as plain paper, coated paper, color copier paper, or an OHP film is contained. Recording mediums are one-by-one fed by transportation by a pickup roller and a transportation roller (which are not illustrated) in sync with transportation of the toner image on the surface of the photoreceptor drum 21 to the transfer nip area.

The information processing section 30 with a CPU (described later) is arranged such that the information processing section 30 reads and writes the information from/in the information storage section 11 of the developing cartridge 1.

The image processing apparatus 31 is arranged such that the image processing apparatus 31 receives the image information from the external device such as a document scanning device (a scanner) or a personal computer, converts the image information to the electric signal and then supplies the converted electric signal to the exposure device 23.

[Developing Cartridge]

The developing cartridge 1 includes a developing container 2 and the developing container 2 has a developer containing part 3 in which a two component developer is contained and a toner containing part 4 in which a toner to be supplied is contained (see FIG. 2). The developing cartridge 1 is detachable from the image forming apparatus 20. The developing container 2 includes, inside the developer containing part 3, a developing roller 5, a stirring roller 6, a regulation member 7 and a toner concentration detecting sensor 8. The developing container 2 includes, inside the toner containing part 4, a toner stirring member 10, a toner discharge member 9, and a toner discharge opening 9*a* via which the developer containing part 3 and the toner containing part 4 communicate with each other. Further, the developing cartridge 1 includes the information storage section 11.

[Developer Containing Part]

The developer containing part 3 contains the two component developer and supplies a toner to the photoreceptor drum 21.

The developing roller 5 is made of a roller-shaped member and driven to rotate around its axis by drive means (not illustrated). The developing roller 5 transports the two component developer to the photoreceptor drum 21 while stirring the two component developer. Note that the developing roller 5 faces the photoreceptor drum 21 via an opening part 2*a* of the developing container 2 and has a given gap between the developing roller 5 and the photoreceptor drum 21 so as to be isolated from the photoreceptor drum 21.

The two component developer transported by the developing roller 5 is in contact with the photoreceptor drum 21 in a part of the developing roller 5 which part is in most proximity to the photoreceptor drum 21. This part in which the two component developer and the photoreceptor drum 21 are in contact is referred to as a developing nip area. At the developing nip area, a developing bias voltage is applied to the developing roller 5 from a power supply (not illustrated) which is connected to the developing roller 5 and then the toner is supplied from the two component developer on a surface of the developing roller 5 to the electrostatic latent image on the surface of the photoreceptor drum 21.

By the stirring roller 6, which is driven to rotate by drive means (not illustrated), the two component developer contained in the developing container 2 is stirred.

The regulation member 7 is made of a plate member which extends in parallel with the axis direction of the developing roller 5. The regulation member 7 is arranged such that one end thereof in its transverse direction is supported by the developing container 2 above the developing roller 5 in a vertical direction of the developing roller 5 and the other end thereof has a given gap between the other end and the surface of the developing roller 5 so as to be isolated from the surface of the developing roller 5. This regulation member 7 can be made of stainless steel. The regulation member 7 can also be made of aluminum, a synthetic resin, or the like.

The toner concentration detecting sensor 8 is provided on a bottom surface of the developer containing part 3 below the stirring roller 6 in a vertical direction of the stirring roller 6. The toner concentration detecting sensor 8 is disposed so that a surface thereof on which a sensor is provided (a top surface) is exposed to inside the developing container 2. The toner concentration detecting sensor 8 is electrically connected to control means (not illustrated). This control means controls the toner discharge member 9 to rotate in response to a result of detection by the toner concentration detecting sensor 8, so as to supply the toner into the developer containing part 3 via the toner discharge opening 9*a*. For example, in a case where it is determined that the result of detection by the toner concentration detecting sensor 8 has a smaller value than a toner concentration set value, a control signal is transmitted to drive means for rotating the toner discharge member 9 so as to drive the toner discharge member 9 to rotate.

The toner concentration detecting sensor 8 can be a general detecting sensor. The toner concentration detecting sensor 8 is exemplified by a transmitted light detecting sensor, a reflected light detecting sensor, and a permeability detecting sensor. The permeability detecting sensor is particularly preferable among these detecting sensors.

The permeability detecting sensor supplies a result of detection of a toner concentration as an output voltage when the permeability detecting sensor receives a control voltage. Basically, the permeability detecting sensor is highly sensitive in the vicinity of the median of output voltages. In view of this, the permeability detecting sensor is used by applying thereon a control voltage which allows the output voltage to be in the vicinity of the median. Such a permeability detecting sensor is commercially available. Example of the permeability detecting sensor include TS-L, TS-A, and TS-K (which are all product names available from TDK Corporation).

A power supply (not illustrated) is connected to the toner concentration detecting sensor 8 for which the permeability detecting sensor is used. The power supply supplies the toner concentration detecting sensor 8 with (i) a drive voltage for causing the toner concentration detecting sensor 8 to be driven and (ii) a control voltage for causing the result of detection of the toner concentration to be supplied to the control means. The supply of the voltages to the toner concentration detecting sensor 8 by the power supply is controlled by the control means.

[Toner Containing Part]

The toner containing part 4 contains the toner and supplies the toner to the developer containing part 3.

The toner stirring member 10 has a rotary shaft 10*a*, a stirring plate 10*b* which is rectangular and rotates around the rotary shaft 10*a*, and a toner scooping blade 10*c* which is fixed to the stirring plate 10*b*. The toner stirring member 10 rotates around the rotary shaft 10*a*, whereby the toner is supplied to the toner discharge member 9 while the toner is being stirred in the toner containing part 4. The toner scooping blade 10*c* can be made, for example, of a polyethylene terephthalate (PET) sheet which is flexible and has a thickness of approximately 0.5 mm to 2 mm. The toner scooping blade 10*c* is provided at both ends of the toner stirring member 10 so that the toner contained in the toner containing part 4 is scooped up and then transported to the toner discharge member 9.

The toner discharge member 9 is provided so as to cover the toner discharge opening 9*a*. The toner discharge member 9 is arranged to receive the toner from the toner scooping blade 10*c* and supply the toner to the developer containing part 3 via the toner discharge opening 9*a*.

The toner stirring member 10 and the toner discharge member 9 are arranged to rotate by a driving force from a gear transmission mechanism and a drive motor (which are not illustrated). In a case where the toner is supplied to the developing cartridge 1 by the developing cartridge 1, the toner contained in the toner containing part 4 is stirred by causing the toner stirring member 10 to rotate in a direction of an arrow E illustrated in FIG. 2 and then scooped up to the toner discharge member 9 by the toner scooping blade 10*c*. In this case, due to a flexible material of which the toner scooping blade 10*c* is made, the toner scooping blade 10*c* changes its shape and rotates while sliding over and being in contact with an inner wall of the toner containing part 4. Then, the toner on a downstream side of a direction in which the toner scooping blade 10*c* rotates is supplied to the toner discharge member 9.

The toner supplied to the toner discharge member 9 is transported by rotation of the toner discharge member 9 so as to be lead to the toner discharge opening 9*a*. Then, the toner is supplied via the toner discharge opening 9*a* to the developer containing part 3.

[Two Component Developer]

The two component developer contained in the developing cartridge 1 contains the toner and a coated carrier. This two component developer can be prepared by mixing the toner and the coated carrier by use of a mixer such as NAUTA mixer. A mixture ratio of the toner to the coated carrier is, for example, 3 parts by weight to 15 parts by weight of the toner to 100 parts by weight of the coated carrier.

[Toner]

The toner contained in the two component developer contained in developer containing part 3 of the developing cartridge 1 or the toner contained in the toner containing part 4 of the developing cartridge 1 is not particularly limited and a publicly-known toner is usable as the toner. Note that the toner contains colored resin particles (toner particles) and, if necessary, external additives attached to surfaces of the respective colored resin particles. It is preferable that the external additives be contained in the toner, from the viewpoint that prevention of toner aggregation prevents a decrease in efficiency at which the toner image is transferred from the photoreceptor drum 21 to the recording medium.

The colored resin particles contain a binder resin, a coloring agent, and, if necessary, a release agent and a charge control agent.

(Binder Resin)

In the present embodiment, the binder resin can be, for instance, a publicly-known resin such as a styrene resin, an acrylic resin, and a polyester resin.

A linear or nonlinear polyester resin is particularly preferable among these resins. The polyester resin is excellent in that a mechanical strength, fixability, and hot offset resistance can be concurrently satisfied. Fine powder is less likely to be produced from the polyester resin and the toner image produced with the polyester resin is less likely to come off from paper after the fixation.

The polyester resin can be obtained by polymerizing a monomer composite of a multivalent alcohol and a polybasic acid each having a valence of not less than two.

A divalent alcohol used for polymerization of the polyester resin is exemplified by: diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol; bisphenol A; hydrogenated bisphenol A; and bisphenol A alkylene oxide adducts such as polyoxyethylene bisphenol A and polyoxypropylane bisphenol A; and the like.

A divalent polybasic acid is exemplified by: maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides of these acids, lower alkyl esters of these acids, and alkenyl succinic acids such as n-dodecenyl succinic acid and n-dodecyl succinic acid, and alkyl succinic acids.

At least one of a multivalent alcohol and a polybasic acid each having a valence of not less than three can be added to the monomer composite according to need. The multivalent alcohol having a valence of not less than three is exemplified by: sorbitol, 1,2,3,6-hexanetetrol, 1,4-sorbitan, pentaerythritol, dipentaerythritol, tripentaerythritol, saccharose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like.

The polybasic acid having a valence of not less than three is exemplified by: 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and anhydrides of these acids.

(Coloring Agent)

In the present embodiment, the coloring agent which can be, for instance, a pigment or a dye which are publicly known and generally used for a toner.

Specifically, the coloring agent for a black toner is exemplified by carbon black and magnetite.

The coloring agent for a yellow toner is exemplified by: (i) acetoacetic acid arylamide monoazo yellow pigments such as C.I. Pigment Yellow 1, C.I. Pigment Yellow 3, C.I. Pigment Yellow 74, C.I. Pigment Yellow 97, and C.I. Pigment Yellow 98, (ii) acetoacetic acid arylamide disazo yellow pigments such as C.I. Pigment Yellow 12, C.I. Pigment Yellow 13, C.I. Pigment Yellow 14, and C.I. Pigment Yellow 17, (iii) condensed monoazo yellow pigments such as C.I. Pigment Yellow 93 and C.I. Pigment Yellow 155, (iv) other yellow pigments such as C.I. Pigment Yellow 180, C.I. Pigment Yellow 150, and C.I. Pigment Yellow 185, and (v) yellow dyes such as C.I. Solvent Yellow 19, C.I. Solvent Yellow 77, C.I. Solvent Yellow 79, and C.I. Disperse Yellow 164.

The coloring agent for a magenta toner is exemplified by: (i) red or crimson pigments such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, C.I. Pigment Red 5, C.I. Pigment Red 146, C.I. Pigment Red 184, C.I. Pigment Red 238, and C.I. Pigment Violet 19 and (ii) red dyes such as C.I. Solvent Red 49, C.I. Solvent Red 52, C.I. Solvent Red 58, and C.I. Solvent Red 8.

The coloring agent for a cyan toner is exemplified by: (i) blue dyes and pigments of copper phthalocyanine and a copper phthalocyanine derivative such as C.I. Pigment Blue 15:3 and C.I. Pigment Blue 15:4 and (ii) green pigments such as C.I. Pigment Green 7 and C.I. Pigment Green 36 (Phthalocyanine Green).

The coloring agent is contained in the colored resin particles preferably in 1 part by weight to 15 parts by weight, more preferably in 2 parts by weight to 10 parts by weight, to 100 parts by weight of the binder resin.

(Charge Control Agent)

A publicly-known charge control agent is usable as the charge control agent for the toner.

The charge control agent which causes the toner to be negatively charged is exemplified by: chromium complex azo dye, iron complex azo dye, cobalt complex azo dye, a chromium, zinc, aluminum, or boron complex or salt compound of salicylic acid and salicylic acid derivatives, a chromium, zinc, aluminum, or boron complex or salt compound of naphthol acid and naphthol acid derivatives, a chromium, zinc, aluminum, or boron complex or salt compound of benzilic acid and benzilic acid derivatives, long chain alkyl carboxylates, and long chain alkyl sulfonates.

The charge control agent which causes the toner to be positively charged is exemplified by: nigrosine dye and nigrosine dye derivatives, triphenylmethane derivatives, and derivatives of quarternary ammonium salt, quarternary phosphonium salt, quarternary pyridinium salt, guanidine salt, amidine salt, and etc., and the like.

The charge control agent is contained in the colored resin particles preferably in 0.1 part by weight to 20 parts by weight, more preferably in 0.5 part by weight to 10 parts by weight, to 100 parts by weight of the binder resin.

(Release Agent)

The release agent contained in the colored resin particles is exemplified by: synthetic wax of polypropylene, polyethylene, and the like, petroleum wax and modified wax thereof such as paraffin wax and paraffin wax derivatives or Microcrystalline wax and a Microcrystalline wax derivative, and plant wax such as carnauba wax, rice wax, or Candelilla wax. It is possible to increase toner releasability to a fixing roller and a fixing belt by causing such a release agent to be contained in the colored resin particles. This can prevent high-temperature offset and low-temperature offset during fixation. An amount of the release agent to be added to the colored resin particles is not particularly limited. The release agent is added to the colored resin particles preferably in not less than 1 part by weight and not more than 5 parts by weight to 100 parts by weight of the binder resin.

It is possible to prepare colored resin particles by a publicly-known method such as a kneading and grinding method or a polymerization method. Specifically, in a case where the kneading and grinding method is employed, a binder resin, a coloring agent, a charge control agent, a release agent and other additives are mixed together by a mixing machine such as Henschel Mixer, Super Mixer, Meccano Mill, or Q-type mixer. A resulting mixture of the raw materials is melted and kneaded at a temperature of approximately 100° C. to 180° C. by a kneading machine such as a two-axis kneading machine or a single-axis kneading machine. A resulting kneaded substance is solidified by cooling and then a resulting solidified substance is ground by an air grinding machine such as Jet Mill. A resulting ground substance is subjected to particle size grading such as classification according to need, whereby the colored resin particles can be prepared.

It is preferable that the colored resin particles preferably have a volume average particle size which falls within 4 μm to 7 μm. The volume average particle size within such a range makes it possible to obtain a high-definition image which is excellent in dot reproducibility and in which fog and/or toner disperse are/is less likely to occur. The volume average particle size is to be defined later.

(External Additive)

It is possible to use, as an external additive which is externally adhered to the colored resin particles, inorganic particles made of silica, titanium oxide, alumina, or the like which have a number average particle size of not less than 7 nm and not more than 100 nm. Note that it is possible to cause the inorganic particles to be hydrophobic by subjecting the inorganic particles to a surface treatment by use of a silane coupling agent, a titanium coupling agent, or silicone oil. The hydrophobic inorganic particles are preferable because a decrease in electric resistance and charge amount is less likely to occur under a high-humidity environment. In particular, silica particles to which surfaces a trimethylsilyl group is introduced by use of hexamethyldisilazane (hereinafter this may be referred to as HMDS) as the silane coupling agent are excellent in hydrophobic and insulation properties. A toner to which these silica particles are externally adhered can provide an excellent charging property even under the high-humidity environment. The number average particle size is to be defined later.

The external additive is specifically exemplified by: Aerosil 50 (a number average particle size: approximately 30 nm), Aerosil 90 (a number average particle size: approximately 30 nm), Aerosil 130 (a number average particle size: approximately 16 nm), Aerosil 200 (a number average particle size: approximately 12 nm), Aerosil 300 (a number average particle size: approximately 7 nm), and Aerosil 380 (a number average particle size: approximately 7 nm) (the above are produced by Nippon Aerosil Co., Ltd. and made of silica), Aluminum Oxide C (produced by Degussa AG (in Germany) and made of alumina; a number average particle size: approximately 13 nm), Titanium Oxide P-25 (produced by Degussa AG (in Germany) and made of titanium oxide; a number average particle size: approximately 21 nm), MOX 170 (produced by Degussa AG (in Germany) and made of a mixture of silica and alumina; a number average particle size: approximately 15 nm), TTO-51 (produced by Ishihara Sangyo Kaisya, LTD. and made of titanium oxide; a number average particle size: approximately 20 nm), and TTO-55 (produced by Ishihara Sangyo Kaisya, LTD. and made of titanium oxide; a number average particle size: approximately 40 nm).

The external additive is mixed with the colored resin particles by use of an air mixing machine such as Henschel Mixer and then externally adhered on a surface of the colored resin particles.

An amount of the external additive to be added to the colored resin particles is preferably 0.2% by weight to 3% by weight. Less than 0.2% by weight of the external additive may not cause the toner to be sufficiently fluid. On the contrary, more than 3% by weight of the external additive may cause a decrease in fixability of the toner.

[Coated Carrier]

The coated carrier contained in the two-component developer contained in the developer containing part 3 of the developing cartridge 1 can be a coated carrier prepared by a general production method or a coated carrier regenerated in accordance with the present invention. First, an embodiment of a general coated carrier is to be described. Note that the coated carrier prepared by the general production method and the coated carrier regenerated by a regenerating method in accordance with the present invention have are identical in structure.

Figure 3:
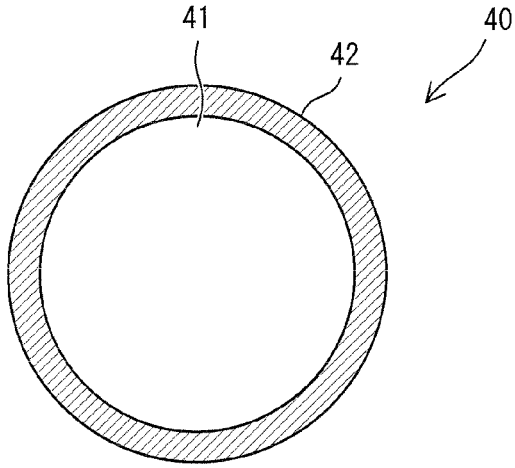
FIG. 3 is a cross-sectional view of a coated carrier.

FIG. 3 is a cross-sectional view schematically illustrating a structure of a coated carrier 40. The coated carrier 40 has a core particle 41 and a coating resin layer (shell layer) 42 which is provided on a surface of the core particle 41 and made of a coating resin.

It is possible to use a publicly-known magnetic particle for the core particle 41 and it is preferable to use a particle containing a ferrite component (a ferritic particle). The core particle 41 containing the ferrite component allows a decrease in carrier density. This causes a reduction in torque on a transporting member and the like in the developer containing part 3. As compared to the case of a carrier in which the core particle 41 contains no ferritic particle, the carrier having the core particle with the ferritic particle (i) can be transported with a smaller force applied thereto by the transporting member and (ii) can reduce abrasion of the coating resin layer. Note that the core particle 41 containing the ferrite component has a high saturation magnetization and is therefore attached to the developing roller 5 at a great strength. This causes the carrier to be less likely to be attached to the photoreceptor drum 21. Use of the core particle 41 containing such a ferrite component allows prevention of a void in an image. The void is caused by the carrier attached to the photoreceptor drum 21.

Accordingly, use of the core particle 41 containing the ferrite component allows (i) further control of a change in charge amount of the toner from an initial stage to a last stage of the life of the toner and (ii) prevention of a void in an image. This allows more stable formation of an image which has a uniform image density.

It is possible to use a publicly-known ferritic particle as the ferritic particle which is the core particle 41 containing the ferrite component. The publicly-known ferritic particle is exemplified by a particle which contains ferrite such as zinc ferrite, nickel ferrite, copper ferrite, nickel-zinc ferrite, manganese-magnesium ferrite, copper-magnesium ferrite, manganese-zinc ferrite, or manganese-copper-zinc ferrite. The ferritic particle has a volume average particle size of 20 μm to 100 μm.

It is possible to prepare ferritic particles by a publicly-known method. For example, ferrite materials such as $Fe_2O_3$ and $Mg(OH)_2$ are mixed together and resulting mixed powder is heated and pre-sintered in a heating furnace. A resulting pre-sintered product is cooled and then ground, by a vibrating mill, so as to be particles having a substantial size of approximately 1 μm. Thereafter, a dispersant and water are added to resulting ground powder, whereby a slurry is prepared. Then, this slurry is wet-milled by a wet ball mill and then a resulting suspension is granulated and dried by a spray dryer, whereby the ferritic particles are obtained.

The coating resin layer 42 with which the surface of the core particle 41 is coated can be made of an acrylic resin, a fluorine resin, or a silicone resin. It is particularly preferable that the coating resin layer 42 be made of a thermosetting silicone resin which is excellent in contamination resistance (filming resistance) and wear resistance against a binder resin for a toner.

The thermosetting silicone resin is a silicone resin which is cured by being cross-linked via hydroxyl groups attached to Si atoms by a thermal dehydration reaction (see the following chemical formula).

Chem. 1

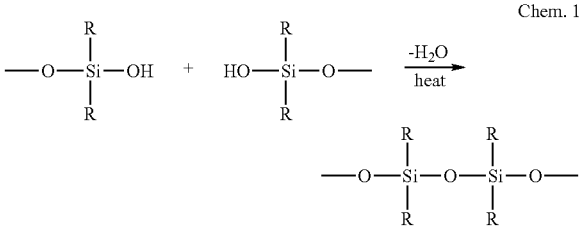

(In the above formula, each of a plurality of Rs denotes an identical or a different monovalent organic group.)

A dimethyl silicone resin in which a monovalent organic group denoted by R is a methyl group is preferable among thermosetting silicone resins. Given that the dimethyl silicone resin in which R is a methyl group has a densely cross-linked structure, the formation of a coating resin layer of a carrier by use of the dimethyl silicone resin makes it difficult for a toner component such as a binder resin to be attached to a surface of the coating resin layer. It therefore becomes possible to obtain a coated carrier which is excellent in at least water repellency and moisture resistance. Accordingly, use of a coated carrier in which a dimethyl silicone resin is used allows more stable formation of an image for a long term without fog with a uniform image density. Note, however, that a too densely cross-linked structure tends to cause a coating resin layer to be fragile. It is therefore important how to select a molecular weight of a silicone resin.

It is preferable that a weight ratio between silicon and carbon which are contained in a silicone resin (Si/C) be not less than 0.3 and not more than 2.2. Si/C of less than 0.3 would cause a deterioration in at least (i) hardness of a coating resin layer and (ii) lifetime of a carrier. Si/C of more than 2.2 would cause a charging property of a carrier with respect to a toner to be susceptible to a change in temperature and cause the coating resin layer to be fragile.

The thermosetting silicone resin is exemplified by Silicon Varnish (produced by Toshiba Corporation: TSR115, TSR114, TSR102, TSR103, YR3061, TSR110, TSR116, TSR117, TSR108, TSR109, TSR180, TSR181, TSR187, TSR144, and TSR165; produced by Shin-Etsu Chemical Co., Ltd.: KR271, KR272, KR275, KR280, KR282, KR267, KR269, KR211, and KR212).

In order to cause the thermosetting silicone resin to be cross-linked, it is necessary to subject the thermosetting silicone resin to a heat treatment at a temperature of approximately 150° C. to 250° C. Note here that it is possible to add a curing catalyst to the thermosetting silicone resin so as to reduce a temperature at which the thermosetting silicone resin is cured. The curing catalyst is exemplified by: octylic acid, tetramethylammonium acetate, tetrabutyl titanate, tetraisopropyl titanate, dibutyltin diacetate, dibutyltin dioctate, dibutyltin laurate, γ-aminopropyltrimethoxysilane, γ-aminopropyltriethoxysilane, N-(β-aminoethyl)aminopropyltrimethoxysilane, γ-aminopropylmethyldiethoxysilane, and N-(β-aminoethyl)aminopropylmethyldimethoxysilane.

The coating resin layer can be formed by use of a publicly-known method. For example, the coating resin layer can be prepared by a dipping method in which: a material of which the coating resin layer is made is dissolved in a solvent, for example, an organic solvent such as toluene or acetone, the core particles are then dipped in a resulting solution, and thereafter the organic solvent is evaporated.

It is possible to further add an electroconductive agent to the coating resin layer. The addition of the electroconductive agent can (i) prevent an increase in charge amount of a toner and (ii) stabilize an image density for a long term. The electroconductive agent is not particularly limited, provided that a volume resistivity of a carrier can be controlled. The electroconductive agent is exemplified by electroconductive agents containing silicon oxide, alumina, carbon black, graphite, zinc oxide, titanium black, ferric oxide, titanium oxide, tin oxide, potassium titanate, calcium titanate, aluminum borate, magnesium oxide, barium sulfate, and calcium carbonate. Such electroconductive agents can be used alone or in combination.

The electroconductive agent containing carbon black is preferable among the above electroconductive agents in terms of preparation stability, costs, and a low electric resistance. Carbon black is not particularly limited in kind. Note, however, that carbon black in which DBP (Dibutyl Phthalate) absorption within 90 ml to 170 ml/100 g is preferable because such carbon black is excellent in preparation stability. Note also that carbon black which has a primary particle diameter of not more than 50 nm is particularly preferable because such carbon black is excellent in dispersibility. The electroconductive agent is contained in the coating resin layer preferably in 0.1 part by weight to 20 parts by weight to 100 parts by weight of a resin of which the coating resin layer is made. This is because less than 0.1 part by weight of the electroconductive agent may make it impossible to realize electroconductivity and more than 20 parts by weight of the electroconductive agent may cause a leak by charge due to its too high electroconductivity.

Figure 4:
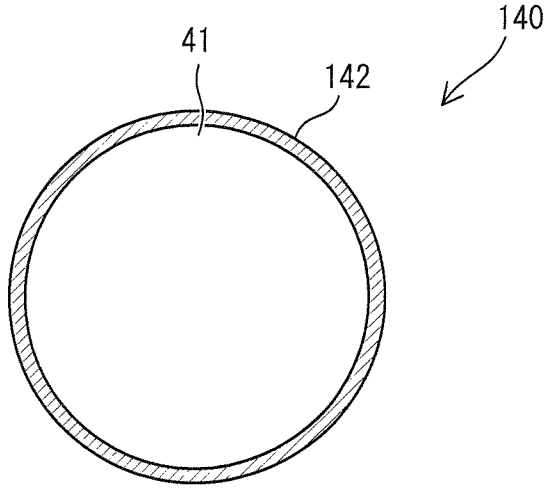
FIG. 4 is a cross-sectional view of a coated carrier which has been stirred for a long term in the developing cartridge.
Figure 5:
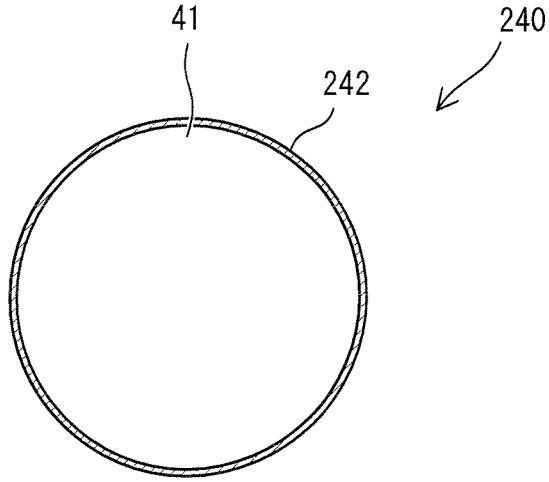
FIG. 5 is a cross-sectional view of a coated carrier which has been stirred for a longer term in the developing cartridge.

Note here that FIGS. 4 and 5 illustrate used coated carriers, i.e., pre-regenerated coated carriers whose coating resin layers are worn. FIG. 4 is a cross-sectional view schematically illustrating a coated carrier 140 whose coating resin layer is worn after the two-component developer containing the coated carrier 40 is stirred for a long term in the developing cartridge 1 of the image forming apparatus 20. The coated carrier 140 is in such a state that a surface of a core particle 41 is coated with a coating resin layer 142 which is made of a coating resin and has become worn and thin.

Note also that FIG. 5 is a cross-sectional view schematically illustrating a coated carrier 240 whose coating resin layer is further worn after the two-component developer containing the coated carrier 40 is stirred for a longer term in the developing cartridge 1 of the image forming apparatus 20. The coated carrier 240 is at an end of its life and in such a state that a surface of a core particle 41 is coated with a coating resin layer 242 which is made of a coating resin and has become worn and extremely thin.

[Information Storage Section]

The following description discusses (i) a CPU 61 of the information processing section 30 included in the image forming apparatus 20 in accordance with the present embodiment and (ii) an IC chip 51 of the information storage section 11 included in the developing cartridge 1. As described earlier, the information storage section 11 is provided on an outer circumferential surface of the developing cartridge 1 (see FIG. 2).

Figure 6:
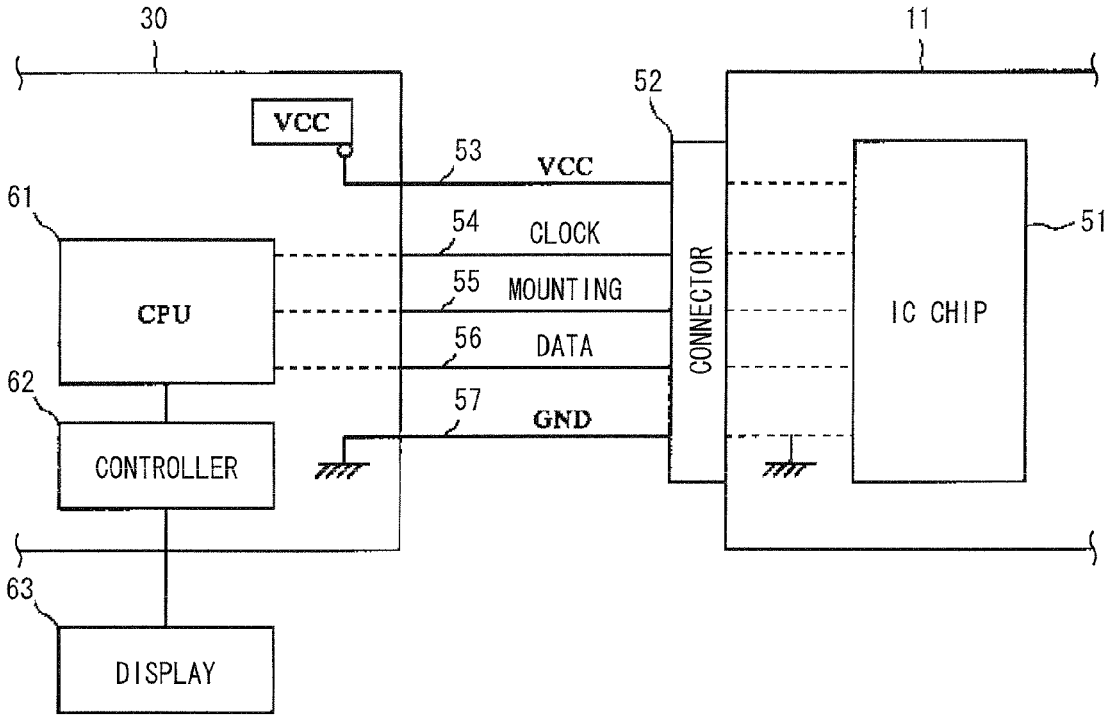
FIG. 6 is an explanatory diagram illustrating how (i) an information storage section included in the developing cartridge and an information processing section included in the image forming apparatus are connected.

FIG. 6 is an explanatory diagram illustrating how (i) the information storage section 11 included in the developing cartridge 1 in accordance with the present embodiment and (ii) the information processing section 30 included in the image forming apparatus 20 are connected with each other. In the information storage section 11, which includes the IC chip 51 (see FIG. 6), various pieces of information on the developing cartridge 1 (e.g., accumulated developer stirring time (accumulated time of stirring of a two component developer) and a remaining amount of the toner contained in the developing cartridge 1) are stored.

When the developing cartridge 1 is mounted (provided) in the image forming apparatus 20, a connector 52 which is electrically connected to the information processing section 30 included in the image forming apparatus 20 is connected with the information storage section 11 included in the developing cartridge 1 (see FIG. 6). According to the present embodiment, the linkage between the information storage section 11 and the connector 52 is realized by employing a direct linking method in which the information storage section 11 and the connector 52 are caused to abut against each other so as to be connected together. The connection can also be wirelessly realized.

The connector 52 is electrically connected to the information processing section 30 included in a main body of the image forming apparatus 20. The information processing section 30 includes the CPU 61 and reads or writes the accumulated developer stirring time stored in the information storage section 11 at a predetermined timing. For example, when (a) a remaining amount of the toner to be supplied reaches 0 (zero) or (b) the accumulated developer stirring time of the developing cartridge 1 exceeds a given threshold, the information processing section 30 instructs a display 63 of an operation panel (not illustrated) included in the image forming apparatus 20 to display a message urging the developing cartridge 1 to be replaced.

When the developing cartridge 1 is mounted in the image forming apparatus 20, (i) the information storage section 11 of the developing cartridge 1 in which information storage section the IC chip 51 has been mounted and (ii) the CPU 61 of the information processing section 30 included in the image forming apparatus 20 are electrically and mechanically connected together via the connector 52, so that a signal is supplied to and from the information storage section 11 and the CPU 61. This causes the IC chip 51 to be grounded via a GND line 57 and operable in response to a supply of a power supply VCC via a power supply line (VCC line) 53 from the information processing section 30 included in the image forming apparatus 20. Note that the IC chip 51 is connected to the CPU 61 via a clock line 54, a data line 56, and a mounting line 55.

The connection between the information processing section 30 and the information storage section 11 causes a clock pulse to be supplied from the CPU 61 to the IC chip 51 via the clock line 54 and allows data communication via the data line 56. In addition, information for checking how the IC chip 51 and the CPU 61 are electrically connected is supplied from the CPU 61 to the IC chip 51 via the mounting line 55.

Note that the information processing section 30 includes a controller 62 for supplying, to the display 63, display data corresponding to a result of determination by the CPU 61 (described later) (see FIG. 6).

Figure 7:
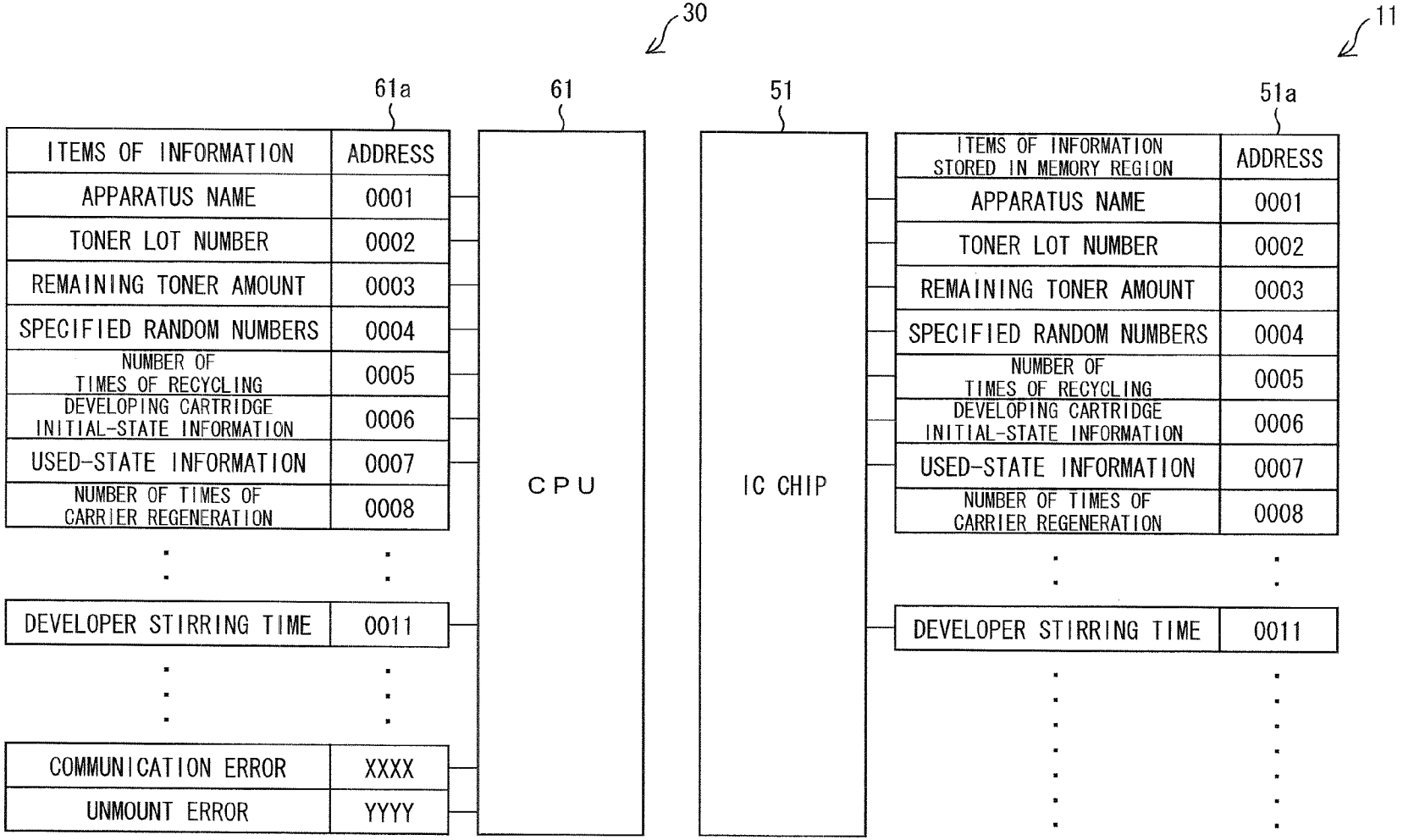
FIG. 7 is an explanatory diagram illustrating pieces of information which are stored in (i) the information processing section of the image forming apparatus and (ii) the information storage section of the developing cartridge, respectively.

Note here that the following description specifically discusses (i) the CPU 61 of the information processing section 30 included in the image forming apparatus 20 in accordance with the present embodiment and (ii) the IC chip 51 of the information storage section 11 included in the developing cartridge 1. FIG. 7 is an explanatory diagram illustrating pieces of information which are stored in (i) the information processing section 30 included in the image forming apparatus 20 in accordance with the present embodiment and (ii) the information storage section 11 included in the developing cartridge 1, respectively.

The IC chip 51 of the information storage section 11 included in the developing cartridge 1 includes a memory 51*a* (see FIG. 7). In the memory 51*a*, pieces of information on the developing cartridge 1 are stored so as to correspond to respective addresses. For example, an apparatus name, a toner lot number, a remaining toner amount, specified random numbers, the number of times of recycling, developing cartridge initial-state information, developing cartridge used-state information, the number of times of carrier regeneration, accumulated developer stirring time, and the like are stored at their respective addresses.

FIG. 7 shows specific examples of information stored at the respective addresses of the memory 51*a* of the IC chip 51. At Address 0001 of the memory 51*a* (see FIG. 7), a model name and a model number of a digital copying machine for which the developing cartridge 1 is usable are stored. At Address 0002, a lot number of the toner contained in the developing cartridge 1 is stored. At Address 0003, an amount of the toner contained in the developing cartridge 1 (a remaining toner amount) is stored. At Address 0004, random numbers which have occurred in the CPU 61 are stored so that whether or not a developing cartridge 1 is identical to the developing cartridge 1 which was previously mounted is checked. At Address 0005, the number of times of recycling of a container of the developing cartridge 1 is stored. At Address 0006, information indicating whether or not the developing cartridge 1 is in an initial state for use (initial-state information) is stored. At Address 0007, information indicating whether or not the developing cartridge 1 has been used up is stored. At Address 0008, the number of times of regeneration of the carrier of the two component developer contained in the developing cartridge is stored. Further, at Address 0011, accumulated developer stirring time of the developing cartridge 1 which time is stored in the memory 51*a* is stored. It goes without saying that the above are merely examples.

The information storage section 11 in which the IC chip 51 in which the accumulated developer stirring time of the developing cartridge 1 is stored is mounted is provided in a given place of the image forming apparatus 20 while being mounted in the developing cartridge 1. Then, the information storage section 11 is connected to the connector which is partially provided in the image forming apparatus 20.

In contrast, the CPU 61 of the information processing section 30 included in the image forming apparatus 20 includes a memory (an information storage section) 61*a*. In this memory 61*a*, (i) pieces of information which have been read via the IC chip 51 so as to correspond to respective addresses and (ii) information on the image forming apparatus 20 are stored.

FIG. 7 shows specific examples of information stored at the respective addresses of the memory 61*a* of the CPU 61. At Address 0001 of the memory 61*a* (see FIG. 7), a name and a model number of an image forming apparatus are stored. At Address 0002, the lot number of the toner contained in the developing cartridge 1 which number has been read via the IC chip 51 is stored. At Address 0003, the amount of the toner contained in the developing cartridge 1 (a remaining toner amount) which amount has been read via the IC chip 51 is stored. At Address 0004, random numbers which have occurred in the CPU 61 are stored so that whether or not a developing cartridge 1 is identical to the developing cartridge 1 which was previously mounted is checked. At Address 0005, the number of times of recycling of the container of the developing cartridge 1 which number has been read via the IC chip 51 is stored. At Address 0006, information indicating a result of determination of whether or not the developing cartridge 1 is in the initial state for use (initial-state information) is stored. At Address 0007, information indicating a result of determination of whether or not the developing cartridge 1 has been used up is stored. At Address 0008, the number of times of regeneration of the carrier of the two component developer contained in the developing cartridge 1 is stored. Further, at Address 0011, the accumulated developer stirring time of the developing cartridge 1 which time is stored in the memory 51*a* is stored. Note that in the memory 61*a*, (i) communication error information and (ii) unmount error information are stored at Address XXXX and Address YYYY, respectively.

During an image forming process, the CPU 61 reads what is stored in the IC chip 51 so as to determine whether or not the accumulated number of rotations of the toner stirring member 10 included in the developing cartridge 1, i.e., the accumulated developer stirring time exceeds specified time (e.g., 30 hours) (see FIG. 7).

Note that the CPU 61 writes information on the IC chip 51 so as to update the accumulated developer stirring time of the developing cartridge 1. Specifically, according to the present embodiment, the CPU 61 reads and rewrites the remaining toner amount and the accumulated developer stirring time which are stored in the IC chip 51. Then, for example, when (a) the remaining amount of the toner contained in the developing cartridge 1 reaches 0 (zero) or (b) the accumulated developer stirring time exceeds specified time (e.g., 30 hours), the CPU 61 causes the display 63 to display the message urging the developing cartridge 1 to be replaced.

Figure 8:
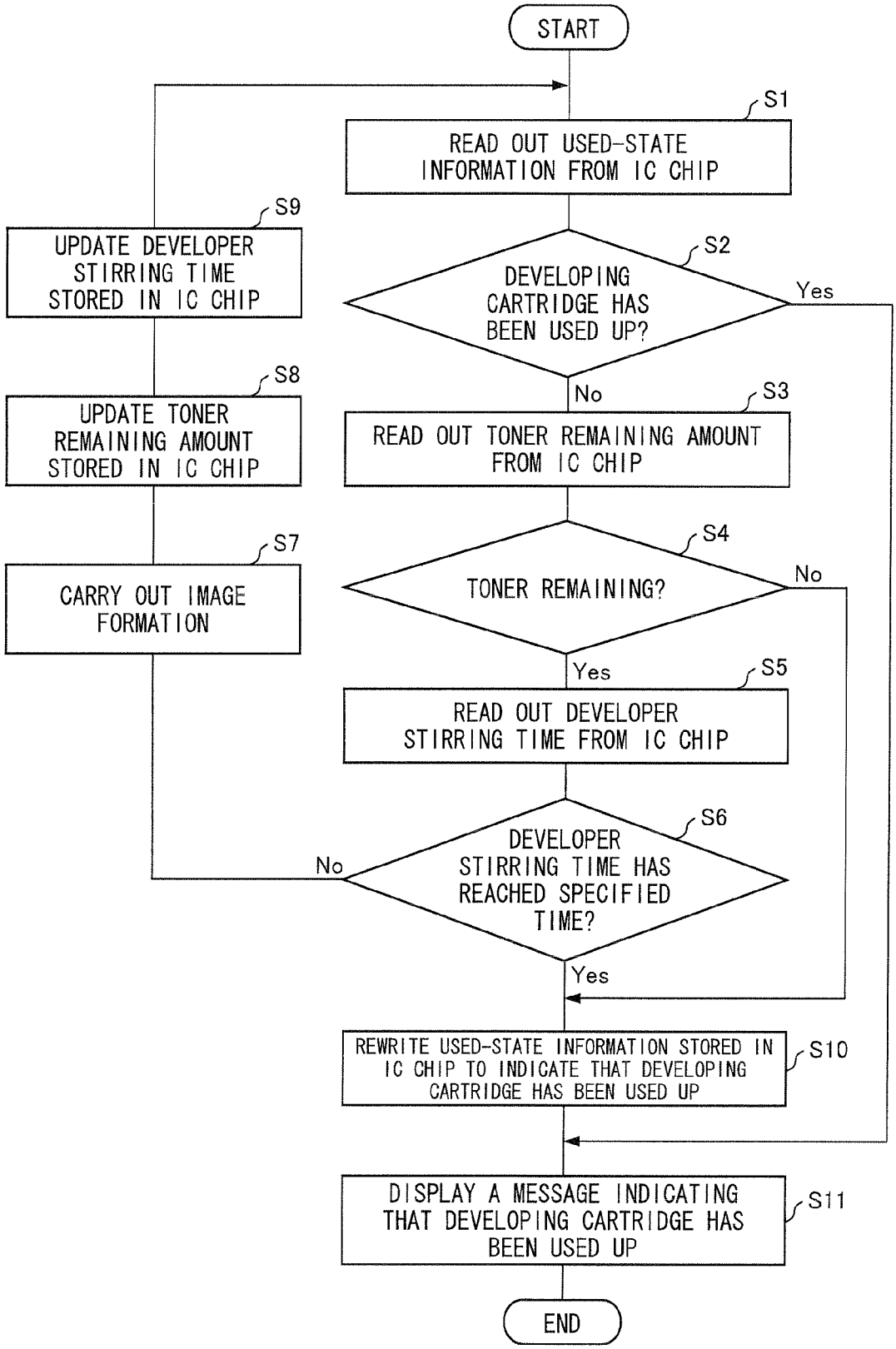
FIG. 8 is a flowchart of a process in which accumulated developer stirring time obtained in the developing cartridge is recorded.

FIG. 8 is a flowchart illustrating steps in which reading and rewriting are carried out with respect to the IC chip 51 of the developing cartridge 1 included in the image forming apparatus 20.

When the image forming apparatus 20 in which the developing cartridge 1 has been mounted is powered on, used-state information of the developing cartridge 1 which information is stored in the IC chip 51 of the developing cartridge 1 is read into the information processing section 30 (Step S1). Next, whether or not the developing cartridge 1 has been used up is determined by the information processing section 30 (Step S2).

In a case where it is determined at Step S2 that the developing cartridge 1 has been used up (Yes at Step S2), the process proceeds to Step S11. In contrast, in a case where it is not determined in Step S2 that the developing cartridge 1 has been used up (No at Step S2), the process proceeds to Step S3.

The information on the remaining toner amount which information is stored in the IC chip 51 is read into the information processing section 30 (Step S3). Then, whether or not the toner remains (whether or not the remaining toner amount is 0 (zero)) is determined by the information processing section 30 (Step S4). In a case where it is not determined in Step S4 that the toner remains (No at Step S4), the process proceeds to Step S10. In contrast, in a case where it is determined in Step S4 that the toner remains (Yes at Step S4), the process proceeds to Step S5.

At Step 5, the information on the developer stirring time is read from the IC chip 51 into the information processing section 30. Then, at Step 6, whether or not the developer stirring time has reached the specified time is determined by the information processing section 30.

In a case where it is not determined at Step S6 that the developer stirring time has reached the specified time (No at Step S6), the process proceeds to Step S7. At Step S7, normal image formation is carried out. Then, at Step 8, how much the toner in the toner containing part 4 of the developing cartridge 1 has been consumed as a result of the image formation carried out at Step S7 is found and then the information on the remaining toner amount is updated in the IC chip 51 based on the toner consumption thus found. Note that the amount of the toner consumed can be found based, for example, on information such as an intensity of light directed from the exposure device 23 toward the surface of the photoreceptor drum 21 (a dot count) or the number of rotations made by the toner discharge member 9. After Step S8, developer stirring time of the stirring roller 6 of the developing cartridge 1 which roller has rotated in accordance with the image formation carried out in Step S7 is counted and then the information on the developer stirring time which information is stored in the IC chip 51 is updated based on the developer stirring time thus counted. Then, the process returns to Step S1.

In contrast, in a case where it is determined at Step S6 that the developer stirring time has reached the specified time (Yes at Step S6), the process proceeds to Step S10. At Step 10, the used-state information stored in the IC chip 51 is rewritten that the developing cartridge 1 has been used up. Then, the process proceeds to Step S11. At Step 11, a message indicating that the developing cartridge 1 has been used up and the message urging replacement of the developing cartridge 1 are displayed on the display 63.

[Coated Carrier Regenerating Method]

The following description discusses an example of an embodiment of the coated carrier regenerating method of the present invention. When (a) the remaining amount of the toner contained in the developing cartridge 1 reaches 0 (zero) or (b) the accumulated developer stirring time exceeds the specified time, the developing cartridge 1 is collected from the image forming apparatus 20 and then the regeneration of the used coated carrier in the developing cartridge 1 is carried out.

First, an amount of a worn-away coating resin of the used coated carrier is found (the step of determining the amount of the worn-away coating resin). The determination can be carried out by: (i) a method in which the amount of the worn-away coating resin is measured by actually thinly slicing coated carrier particles and then observing the coated carrier particles thus sliced by use of a transmissive electron microscope and (ii) a method in which the amount of the worn-away coating resin is found based on the accumulated developer stirring time stored in the information storage section 11 of the developing cartridge 1 which has been collected. Note, however, that it is more preferable to find the amount of the worn-away coating resin based on the accumulated developer stirring time. This is because the measurement by the method (i) in which the amount of the worn-away coating resin is measured by the observation by use of the transmissive electron microscope requires considerable time and effort. In the case of using the accumulated developer stirring time to determine the amount of the worn-away coating resin, a relationship between the accumulated developer stirring time and the amount of the worn-away coating resin can be found out in advance by use of a coated carrier and a developing cartridge which are to be used, so that the amount of the worn-away coating resin of the coated carrier to be regenerated can be found with reference to data on this relationship.

Note here that the accumulated developer stirring time is read out from the IC chip 51 of the information storage section 11 included in the developing cartridge 1 which has been collected and then the amount of the worn-away coating resin of the coated carrier to be regenerated is found and determined.

Note that an amount of the coating resin to be added (used) in order to regenerate the used carrier is found as below. A relationship between the amount of the coating resin to be added and the thickness of the coating resin layer is found in advance (the step of finding the relationship) and then the amount of the coating resin to be added for supplementing the amount of the worn-away coating resin (regaining an original thickness of the coating resin layer) based on the relationship.

The used coated carrier collected from the developing cartridge 1 is first cleaned by use of a solvent for dissolving the binder resin contained in the toner (the step of cleaning the used coated carrier). For example, the cleaning can be carried out 2 times to 4 times by use of an organic solvent such as toluene or THF in an amount greater than the coated carrier by 10 to 20 times by weight. This allows removal of the binder resin contained in the toner attached to a surface of the used coated carrier.

It is necessary that the solvent for dissolving the binder resin contained in the toner should not dissolve the coating resin. However, in a case where the coating resin is not a curing resin and no solvent that does not dissolve the coating resin but dissolves the binder resin contained in the toner can be found, the step of cleaning the used coated carrier is omitted.

Next, (i) the coating resin to be added which has the amount found based on the amount of the worn-away coating resin and (ii) an additive such as an electroconductive agent are dissolved/dispersed in a solvent (e.g., an organic solvent containing toluene, acetone, or the like). Then, the coated carrier which has been cleaned is dipped in the solvent, whereby the used coated carrier is supplementarily coated with the coating resin. Thereafter, a regenerated coated carrier is obtained by evaporating the solvent.

According to the coated carrier regenerating method as described above, the amount of the worn-away coating resin of the used coated carrier is determined in a case where the coated carrier is regenerated by supplementarily coating the used coated carrier with the coating resin. Accordingly, an amount of the coating resin layer to be supplemented, namely an amount of the coating resin with which the coating resin layer is to be supplementarily coated is found based on this amount of the worn-away coating resin, whereby the supplementary coating of the used coated carrier can be carried out with the coating resin in the amount thus determined. This allows regeneration of a coated carrier in which a coating resin has a uniform thickness, that is, a coating resin has a thickness which is unchanged from the thickness obtained before use of the coated carrier, without the need of completely removing the coating resin from the used coated carrier.

Note here that it has been conventionally unnecessary to find an amount of a worn-away coating resin in a case where coating is carried out after a coating resin is removed. Alternatively, even in a case where supplementary coating is carried out without removing the coating resin, the coating has been carried out without finding the amount of the worn-away coating resin. Thus, the amount of the worn-away coating resin has not been found. Therefore, in a case where the supplementary coating is carried out while a part of the coating resin remains on a surface of a core particle, a coating resin layer of a regenerated carrier has a larger thickness and then becomes nonuniform as the number of regeneration of the carrier increases.

However, according to the method of the present invention, the amount of the worn-away coating resin is determined. Therefore, it is possible to easily regenerate a coated carrier in which a coating resin layer has a uniform thickness irrespective of an increase in number of times of regeneration of a coating resin, while saving time and costs required to remove before regenerating the coating resin layer.

Note that for regeneration of a coated carrier, it is possible to use a publicly-known apparatus which is used to coat a carrier with a coating resin such as a coating device for a dipping method.

After the coated carrier is regenerated, the number of times of regeneration of the coated carrier is counted (the step of counting the number of times of regeneration of the coated carrier) and then the information stored in the IC chip 51 of the information storage section 11 included in the developing cartridge 1 is rewritten. Note that in a case where the number of times of regeneration of the coated carrier is read out from the IC chip 51 before the coated carrier is regenerated and the number of times of the regeneration reaches the given number of times, the coated carrier is not regenerated and then the used coated carrier is disposed of. This limits the number of times of regeneration of the coated carrier. It is therefore possible to prevent a carrier breakage due to a crack in the core particle of the coated carrier which crack occurs by repeating the regeneration many times. Note that in a case where the number of times of the regeneration does not reach the given number of times, the regeneration is repeatedly carried out until the number of times of the regeneration reaches the given number of times.

EXAMPLES

Preparation of Coated Carrier

A slurry which contained ferrite materials of (i) 50 mol % of ferric oxide (produced by KDK Corporation), (ii) 35 mol % of manganese oxide (produced by KDK Corporation), (iii) 14.5 mol % of magnesium oxide (produced by KDK Corporation), and (iv) 0.5 mol % of strontium oxide (produced by KDK Corporation) and in which water served as a solvent was ground for 4 hours by a ball mill. This slurry was dried by a spray dryer and then resulting spheric particles were pre-sintered in a rotary kiln at 930° C. for 2 hours. Resulting pre-sintered powder was dispersed in water and then finely grinded, by a wet grinding mill (a steel ball was used as a grinding medium), into pieces having a mean particle diameter of not more than 2 μm. After adding 2% by weight of PVA thereto, this slurry was granulated and dried and then sintered at 1100° C. for 4 hours in an electric furnace which had an oxygen level of 0 (zero) % by volume. Thereafter, disintegration and classification was carried out, thereby obtaining core particles F which had a volume average particle size of 44 μm and a volume resistivity of $1\times10^{9}$ Ωcm and were made of a ferrite component.

On the other hand, a coating solution H was prepared by dissolving/dispersing, in 890 parts by weight of toluene, (i) 100 parts by weight of dimethyl silicone resin (produced by Momentive Performace Materials Inc.), (ii) 5 parts by weight of carbon black (MA-100 produced by Mitsubishi Chemical Corporation), and (iii) 5 parts by weight of octylic acid as a curing agent.

100 parts by weight of the core particles F were dipped in 40 parts by weight of the coating solution H in the coating device for a dipping method (product name: Versatile Mixer NDMV type, produced by Dalton Corporation), whereby the core particles F were coated with the coating solution H. Thereafter, the toluene was completely removed by evaporation. Then, the core particles F were heated in an oven at 150° C. for 60 minutes so as to be subjected to a thermal curing treatment, whereby a coated carrier C which was 100 percent coated with a thermosetting silicone resin was prepared. The coated carrier C had a volume average particle size of 45 μm, a volume resistivity of $2.1\times10^{12}$ Ωcm, and a saturation magnetization of 65 emu/g. A coating resin layer of the coated carrier C had a thickness of 1.12 μm (an average thickness for 30 points on the coating resin layer).

<Measuring Method>

In the present Examples, properties were measured by the following method. In the present Examples, the respective volume average particle sizes of the core particles F and the coated carrier C refer to values measured under a condition of a dispersive pressure of 3.0 bar by use of a dry dispersing device RODOS (produced by Sympatec GmbH) for a laser diffraction particle size analyzer HELOS (produced by Sympatec GmbH). The measurement was carried out by a method such that (i) 0.1 ml to 5 ml of a surfactant, preferably alkyl benzene sulfonate as a dispersant and (ii) 2 mg to 20 mg of colored resin particles as a measurement sample were added to 100 ml to 150 ml of an electrolytic aqueous solution. The electrolytic aqueous solution in which the measurement sample was suspended was subjected to a dispersion treatment by an ultrasonic dispersion machine for approximately 1 minute to 3 minutes. Then, a volume and the number of the colored resin particles were measured by the analyzer at an aperture of 100 μm, whereby a volume particle size distribution and a number particle size distribution of the colored resin particles were found. Thereafter, a volume average particle size of the colored resin particles was found based on the volume particle size distribution of the colored resin particles.

In the present Examples, the saturation magnetization of the coated carrier C refers to a value measured by VSMP-1 produced by Toei Industry Co., Ltd.

In the present Examples, the respective volume resistivities of the core particles F and the coated carrier C refer to values measured by the following procedure. First, a space between two copper electrodes which were provided with a gap of 6.5 mm therebetween and had a width of 30 mm and a height of 10 mm was filled with the core particles F under environmental conditions of a temperature of 20° C. and a humidity of 65%. Next, a bridge made of the core particles was formed by a line of magnetic force between two magnets (100 mT) which were provided in regions outside the respective copper electrodes so that the N-pole and the S-pole of the two magnets face each other. A value which was measured in this state 15 seconds after application of a voltage of 500V was referred to as the volume resitivity of the core particles F. The volume resitivity of the coated carrier was similarly measured.

In the present Examples, a ratio at which surfaces of the core particles F are coated with the coating resin layer refers to a value found based on the following method. An observation was carried out by an electron beam having an accelerating voltage of 2.0 eV by use of a scanning electron microscope (SEM) without vapor-depositing an electroconductive agent such as gold on a surface of the coated carrier C. In this case, the coating resin layer was observed to be white in the coated carrier C due to electrification. A ratio of an area of a white region to a total area of the coated carrier C was found. This finding was carried out with respect to 40 pieces of the coated carrier C and then an average of obtained values was referred to as the ratio at which the surfaces of the core particles F were coated with the coating resin layer.

<Preparation of Toner>

The following were used as toner materials.

- 100 parts by weight of polyester resin (EP-208: produced by Sanyo Chemical Industries, Ltd.)
- 5 parts by weight of carbon black (product name: MA-100, produced by Mitsubishi Chemical Corporation)
- 2 parts by weight of a charge control agent (a boron compound, product name: LR-147, produced by Japan Carlit Co., Ltd.)
- 2 parts by weight of polypropylene wax (550P, produced by Sanyo Chemical Industries, Ltd.)

The toner materials were mixed by Henschel Mixer for 10 minutes and then melted and kneaded by a kneading and dispersion treatment apparatus (product name: Kneadex MOS140-800, produced by Nippon Coke & Engineering Co., Ltd.), whereby a kneaded substance in which the toner materials except a binder resin were dispersed in the binder resin was obtained. This kneaded substance was roughly ground by a cutting mill and then finely ground by a jet mill (product name: IDS-2, produced by Nippon Pneumatic Mfg. Co., Ltd.). A resulting finely-ground substance was classified by use of a pneumatic classifier (product name: MP-250, produced by Nippon Pneumatic Mfg. Co., Ltd.), whereby the colored resin particles which have a volume average particle size of 6.5 μm were obtained.

100 parts by weight of the colored resin particles thus obtained, to which (i) 1 part by weight of silica particles (product name: R976S, produced by Nippon Aerosil Co., Ltd.) which have a number average particle size of 14 nm and have been subjected to a surface treatment by hexamethyldisilazane and (ii) 0.5 part by weight of magnetite which has a number average particle size of 300 nm (product name: BL-220, produced by Titan Kogyo, Ltd.) were added as external additives, were stirred for 2 minutes by the air mixing machine (Henschel Mixer, produced by Nippon Coke & Engineering Co., Ltd.) in which a stirring blade had a tip velocity of 15 m/sec, whereby a toner T which was negatively charged was prepared.

In the present Examples, the volume average particle size of the colored resin particles refers to a value measured by Coulter Multisizer II (produced by Beckman Coulter, Inc.) at an aperture of 100 μm. Note that Coulter Counter TA-II is also usable as a measuring apparatus. Approximately 1% of an NaCl aqueous solution containing primary sodium chloride is used as an electrolytic solution. The approximately 1% of the NaCl aqueous solution is exemplified by ISOTON R-II (produced by Coulter Scientific, Japan).

<Preparation of Two Component Developer>

6 parts by weight of the toner T as prepared above and 94 parts by weight of the coated carrier C as prepared above were put into NAUTA mixer (product name: VL-0, produced by Hosokawa Micron Group) and then stirred and mixed for 20 minutes, whereby a two component developer D was prepared.

<Preparation of Worn Carrier Samples>

The two component developer D and the toner T were set in a remodeled machine of a digital copying machine (see FIG. 1) (produced by Sharp Corporation: AR-267). Then, 5K to 20K A4-sized documents which have respective coverages of 5%, 10%, and 15% were copied intermittently for every 2 documents (an aging test was carried out). After the copying, only the toner of the two component developer collected was removed by suction by use of a filter of 400 meshes, whereby worn carrier samples S1 to S6 serving as samples of the used coated carrier were prepared. Table 1 shows conditions under which the worn carrier samples S1 to S6 were prepared.

In practice, when the remaining amount of the toner contained in the toner containing part 4 of the developing cartridge 1 reaches 0 (zero), the developing cartridge 1 becomes unusable and then is to be collected even if the two component developer has not reached its life end. However, during the preparation of the worn carrier samples of the present Examples, the toner containing part 4 was supplemented with the toner T as needed so that the remaining amount of the toner of the developing cartridge 1 would not reach 0 (zero).

TABLE 1

| Worn carrier sample | Coverage (%/documents) | Number of aged documents (documents) | Accumulated developer stirring time (minutes) |
|---|---|---|---|
| S1 | 5 | 5K | 630 |
| S2 | 5 | 10K | 1260 |
| S3 | 5 | 15K | 1890 |
| S4 | 5 | 20K | 2520 |
| S5 | 10 | 10K | 1260 |
| S6 | 15 | 10K | 1260 |

<Accumulated Developer Stirring Time and Amount of Worn-Away Coating Resin>

In addition to the aging test carried out during the preparation of the worn carrier samples, the relationship between accumulated developer stirring time and an amount of a worn-away coating resin of the coated carrier was found by use of the two component developer D and the remodeled machine of the digital copying machine (produced by Sharp Corporation: AR-267). The amount of the worn-away coating resin was found in percentages (%) on the assumption that a thickness of a coating resin which had not been worn (1 μm) was regarded as 100%. The finding was carried out by thinly slicing the coated carrier particles which had been sampled and then observing the coated carrier particles thus sliced by use of the transmissive electron microscope. Table 2 shows a result of the finding. Note that the following equation is an approximation formula for conversion by which the amount of the worn-away coating resin is derived from the accumulated developer stirring time based on the result of the finding.

TABLE 2

| Accumulated developer stirring time (minutes) | Amount of worn-away coating resin (%) |
|---|---|
| 0 minute | 0% |
| 1000 minutes | 25% |
| 2000 minutes | 48% |
| 3000 minutes | 71% |

Approximation formula for conversion: Amount of worn-away coating resin (%)=Accumulated developer stirring time (minutes)×0.024

Amounts of the worn-away coating resin of the respective worn carrier samples as prepared above were found by use of the approximation formula for conversion. Table 3 shows a result of the finding.

TABLE 3

| Worn carrier sample | Accumulated developer stirring time (minutes) | Amount of worn-away coating resin (%) |
|---|---|---|
| S1 | 630 | 15.1 |
| S2 | 1260 | 30.2 |
| S3 | 1890 | 45.4 |
| S4 | 2520 | 60.0 |
| S5 | 1260 | 30.2 |
| S6 | 1260 | 30.2 |

<Regeneration of Coated Carrier>

A coated carrier to be regenerated is first cleaned by use of a solvent for dissolving a binder resin contained in a toner. The cleaning is carried out 2 times to 4 times by use of the solvent such as toluene or THF in an amount greater than the coated carrier by 10 to 20 times by weight. This allows removal of the binder resin contained in the toner attached to a surface of the coated carrier.

The cleaning was carried out two times with respect to each of the worn carrier samples S1 to S6 by use of THF which is a solvent for dissolving a binder resin (polyester resin) contained in a toner.

On the other hand, an amount of the coating resin to be used with which the coated carrier was supplementarily coated was found based on the amount of the worn-away coating resin. Note here that an amount of the coating solution H containing the coating resin was found as the amount of the coating resin to be used with which the coated carrier was supplementarily coated. Namely, the coating resin is contained in the ratio as mentioned above and the coating solution H is used for the coating. Therefore, the amount of the coating resin to be used is naturally found by finding the amount of the coating solution H. In the present Examples, 100% of the coating resin layer of the coated carrier was obtained by mixing 100 parts by weight of the core particles F and 40 parts by weight of the coating solution H as described earlier. Therefore, an amount of the coating solution H to be added during regeneration of the coated carrier was found based on the formula of 40 parts by weight×Amount of worn-away coating resin (%).

Table 4 shows a result of finding. Note the coating solution H (parts by weight) in Table 4 refers to an amount to 100 parts by weight of the coated carrier.

TABLE 4

| | Worn carrier sample | Amount of worn-away coating resin (%) | Coating solution H (parts by weight) | Regenerated coated carrier |
|---|---|---|---|---|
| Example 1 | S1 | 15.1 | 6 | C1 |
| Example 2 | S2 | 30.2 | 12 | C2 |
| Example 3 | S3 | 45.4 | 18 | C3 |
| Example 4 | S4 | 60.0 | 24 | C4 |
| Example 5 | S5 | 30.2 | 12 | C5 |
| Example 6 | S6 | 30.2 | 12 | C6 |

Next, each of the worn carrier samples S1 to S6 which had 100 parts by weight and had been cleaned in the coating solutions H which have respective amounts shown in Table 4 was dipped in the coating device for a dipping method (product name: Versatile Mixer NDMV type, produced by Dalton Corporation), whereby the worn carrier samples were coated with the respective coating solutions H. Thereafter, the toluene was completely removed by evaporation. Then, each of the worn carrier samples S1 to S6 was heated in the oven at 150° C. for 60 minutes so as to be subjected to the thermal curing treatment, whereby regenerated coated carriers C1 to C6 each of which was 100 percent coated with the thermosetting silicone resin were prepared (regenerated).

<Evaluation>

A measurement of (i) a volume average particle size, (ii) a volume resistivity, (iii) a saturation magnetization, and (iv) a thickness of the coating resin layer (a shell layer) (an average thickness for 30 points on the coating resin layer) was carried out with respect to the regenerated coated carriers C1 to C6. Table 5 shows a result of the measurement. For each of the above (i) to (iv), the regenerated coated carriers C1 to C6 had respective values which were substantially identical to those obtained in the coated carrier (whose coating resin layer had a thickness of 1.12 μm).

The above description shows that finding of an amount of a worn-away coating resin allows easy obtainment of a regenerated coated carrier in which a coating resin layer has a uniform thickness.

TABLE 5

| | Regenerated coated carrier | Volume average particle size (μm) | Volume resistivity (Ω cm) | Saturation magnetization (emu/g) | Thickness of regenerated coating resin layer (μm) |
|---|---|---|---|---|---|
| Example 1 | C1 | 45 | $1.8 \times 10^{12}$ | 65 | 1.11 |
| Example 2 | C2 | 45 | $2.2 \times 10^{12}$ | 65 | 1.12 |
| Example 3 | C3 | 45 | $2.0 \times 10^{12}$ | 65 | 1.13 |
| Example 4 | C4 | 45 | $2.1 \times 10^{12}$ | 65 | 1.11 |
| Example 5 | C5 | 45 | $2.2 \times 10^{12}$ | 65 | 1.12 |
| Example 6 | C6 | 45 | $2.1 \times 10^{12}$ | 65 | 1.13 |

A coated carrier regenerating method of the present invention in which a coated carrier whose surface is coated with a coating resin layer is regenerated from a used coated carrier by supplementarily coating the surface of the used coated carrier with a coating resin, the coated carrier regenerating method includes the step of: (a) determining an amount of a worn-away coating resin of the used coated carrier.

The coated carrier regenerating method of the present invention can be arranged such that the amount of the worn-away coating resin is determined in the step (a) by finding the amount of the worn-away coating resin based on accumulated time of stirring of a two component developer in which the used coated carrier is used.

According to the method, it is possible to find the amount of the worn-away coating resin based on the accumulated time of stirring of the two component developer in which the used coated carrier is used. This is because the amount of the worn-away coating resin increases as the accumulated time of stirring of the two component developer becomes longer. This makes it possible to dispense with an actual measurement (e.g., a measurement by use of a transmissive electron microscope) of the amount of the worn-away coating resin of the used coated carrier. This allows easy finding of an amount of a worn-away coating resin and causes an increase in efficiency of producing a regenerated coated carrier.

The coated carrier regenerating method of the present invention can be arranged to further include the steps of: (b) finding a relation between an amount of the coating resin to be used with which an unused carrier is coated and a thickness of the coating resin layer; and (c) determining, based on (i) the amount of the worn-away coating resin determined in the step (a) and (ii) the relation found in the step (b), an amount of the coating resin to be used with which the used coated carrier is supplementarily coated.

The coated carrier regenerating method of the present invention can be arranged such that: the coating resin is a thermosetting silicone resin; and the coated carrier regenerating method further includes the step of: (d) cleaning the used coated carrier by use of a solvent which (i) dissolves a resin contained in a toner of the two component developer in which the used coated carrier is contained but (ii) does not dissolve the coating resin.

According to the method, the coating resin, which is the thermosetting silicone resin, is excellent in contamination resistance (filming resistance) and wear resistance against a resin contained in a toner. In addition, the used coated carrier is cleaned by use of the solvent which (i) dissolves the resin contained in the toner of the two component developer in which the used coated carrier is contained but (ii) does not dissolve the coating resin. For this reason, before subjecting the used coated carrier to the supplementary coating, it is possible to remove, by use of the solvent, the resin contained in the toner which is attached to the used coated carrier. This can prevent inclusion, in the coating resin, of the resin contained in the toner.

It is preferable that the coated carrier regenerating method of the present invention further include the step of: (e) counting the number of times of regeneration of the coated carrier, the regeneration including the step (a), being repeatedly carried out until the number of times of the regeneration reaches a given number of times.

According to the method, the number of times of the regeneration of the coated carrier is limited. It is therefore possible to prevent a carrier breakage due to a crack in a core particle of the coated carrier which crack occurs by repeating the regeneration many times.

In order to attain the object, a regenerated coated carrier of the present invention is a coated carrier regenerated by any one of the coated carrier regenerating methods as mentioned above.

According to the arrangement, it is possible to provide a regenerated coated carrier in which a coating resin has a uniform thickness because the coating resin is regenerated by the coated carrier regenerating method in accordance with the present invention.

Therefore, according to an image forming apparatus in which image formation is carried out by use of a two component developer containing (i) this regenerated coated carrier in which the coating resin has a uniform thickness and (ii) a toner, it is possible to stably form a high-definition image.

A developing container of the present invention is arranged such that a two component developer is contained in the developing container. Accordingly, the developing container which is detachably provided in the image forming apparatus allows regeneration of a coated carrier, for example in a coated carrier regenerating factory, only by detaching the developing container from the image forming apparatus.

The developing container of the present invention can also be arranged to include: an information storage section in which accumulated time of stirring of the two component developer is stored. According to the arrangement, in a case where the amount of the worn-away coating resin is found based on the accumulated time of stirring of the two component developer, it is possible to easily read out the accumulated time from the information storage section of the developing container, for example in the coated carrier regenerating factory.

The developing cartridge of the present invention can also be arranged such that the number of times of regeneration of the regenerated coated carrier contained in the two component developer is further stored in the information storage section. Such storage of the number of times of the regeneration of the regenerated coated carrier allows the number to be read out from the information storage section so that the number is limited.

The embodiments and concrete examples of implementation discussed in the aforementioned detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below. It goes without saying that a numerical range which is different from that described herein and falls within a reasonable range consistent with the object of the present invention is encompassed in the present invention.

INDUSTRIAL APPLICABILITY

Use of a coated carrier regenerating method of the present invention allows, in a shorter time and at a lower cost, regeneration of a coated carrier in which a coating resin has a uniform thickness. Accordingly, the coated carrier regenerating method of the present invention is suitably applicable to image forming apparatuses such as a copying machine, a printer, and a facsimile each of which employs an electrophotographic printing method.

| Reference Signs List | |
|---|---|
| 1 | Developing cartridge |
| 2 | Developing container |
| 3 | Developer containing part |
| 4 | Toner containing part |
| 11 | Information storage section |
| 20 | Image forming apparatus |
| 30 | Information processing section |
| 40 | Coated carrier |
| 41 | Core particle |
| 42 | Coating resin layer |
| 51 | IC chip (Information storage section) |
| 61 | CPU |
| 140, 240 | Coated carrier (Used coated carrier) |
| 142, 242 | Thinned coating resin layer |

REFERENCE SIGNS LIST

1 Developing cartridge
2 Developing container
3 Developer containing part
4 Toner containing part
11 Information storage section
20 Image forming apparatus
30 Information processing section
40 Coated carrier
41 Core particle
42 Coating resin layer
51 IC chip (Information storage section)
61 CPU
140, 240 Coated carrier (Used coated carrier)
142, 242 Thinned coating resin layer

The invention claimed is:

1. A coated carrier regenerating method in which a coated carrier whose surface is coated with a coating resin layer is regenerated from a used coated carrier by supplementarily coating the surface of the used coated carrier with a coating resin, said coated carrier regenerating method comprising the steps of:

(a) determining an amount of a worn-away coating resin of the used coated carrier by (i) thinly slicing a used coated carrier particle and observing the sliced used coated carrier particle or (ii) determining an accumulated time of stirring of a two component developer in which the used coated carrier is used and comparing the accumulated time to a predetermined relationship between accumulated time of stirring and amount of worn-away coating resin, (b) coating the used coated carrier with a coating resin to be added in an amount found according to the determined amount of the worn-away coating resin, the coating being carried out without removing a coating resin from the used coated carrier.

2. The coated carrier regenerating method as set forth in claim 1, wherein:

the coating resin is a thermosetting silicone resin; and said coated carrier regenerating method further comprises the step of:

(d) cleaning the used coated carrier by use of a solvent which (i) dissolves a resin contained in a toner of the two component developer in which the used coated carrier is contained but (ii) does not dissolve the coating resin.

3. The coated carrier regenerating method as set forth in claim 1, further comprising the step of:

(e) counting the number of times of regeneration of the coated carrier, the regeneration including the step (a), being repeatedly carried out until the number of times of the regeneration reaches a given number of times.

4. A developing cartridge in which a two component developer containing (i) a regenerated coated carrier regenerated by a coated carrier regenerating method recited in claim 1 and (ii) a toner is contained.

5. The developing cartridge as set forth in claim 4, comprising:

an information storage section in which accumulated time of stirring of the two component developer is stored.

6. The developing cartridge as set forth in claim 5, wherein the number of times of regeneration of the regenerated coated carrier contained in the two component developer is further stored in the information storage section.

7. An image forming apparatus detachably provided with a developing cartridge recited in claim 4.

8. The coated carrier regenerating method as set forth in claim 1, wherein the predetermined relationship between accumulated time of stirring and amount of worn-away coating resin is represented by a formula: amount of worn-away coating resin (%)=Accumulated developer stirring time (minutes)×0.024.

* * * * *